US006574980B1

(12) United States Patent
Morrison

(10) Patent No.: US 6,574,980 B1
(45) Date of Patent: Jun. 10, 2003

(54) CIRCUITING ARRANGEMENT FOR A CLOSED CIRCUIT COOLING TOWER

(75) Inventor: Frank T. Morrison, Anne Arundel, MD (US)

(73) Assignee: Baltimore Aircoil Company, Inc., Jessup, MD (US)

( * ) Notice: Subject to any disclaimer, the term of this patent is extended or adjusted under 35 U.S.C. 154(b) by 152 days.

(21) Appl. No.: 09/668,597

(22) Filed: Sep. 22, 2000

(51) Int. Cl.[7] ..... F28D 5/00

(52) U.S. Cl. ..... 62/305; 62/304; 62/314; 62/315

(58) Field of Search ..... 62/314, 304, 305, 62/315

(56) References Cited

U.S. PATENT DOCUMENTS

| | | | | |
|---|---|---|---|---|
| 3,572,657 A | | 3/1971 | Bradley, Jr. | |
| 3,575,387 A | | 4/1971 | Bradley, Jr. et al. | |
| 3,804,389 A | | 4/1974 | Engalitcheff, Jr. et al. | |
| 4,104,112 A | * | 8/1978 | Stutz | 159/4 |
| 4,172,786 A | * | 10/1979 | Humphrey et al. | 210/57 |
| 4,196,157 A | | 4/1980 | Schinner | |
| 4,518,544 A | | 5/1985 | Carter et al. | |
| 4,568,022 A | | 2/1986 | Scrivnor | |
| 5,084,217 A | * | 1/1992 | Dodds | 261/36.1 |
| 5,273,687 A | * | 12/1993 | Osborne | 261/29 |
| 5,349,829 A | * | 9/1994 | Tsimerman | 62/314 |
| 5,435,382 A | | 7/1995 | Carter | |
| 5,596,877 A | | 1/1997 | Morrison | |
| 5,724,828 A | | 3/1998 | Korenic | |
| 6,141,986 A | * | 11/2000 | Koplin | 62/304 |
| 6,213,200 B1 | * | 4/2001 | Carter et al. | 165/285 |

* cited by examiner

*Primary Examiner*—William C. Doerrler
*Assistant Examiner*—Mark Shulman
(74) *Attorney, Agent, or Firm*—Edward J. Brosius

(57) ABSTRACT

The final segment in one-half or one-third circuit tube assemblies are arranged in a concurrent manner with the air flow in a closed-circuit cooling tower to more fully utilize spray-water cooling that occurs in the region below the tube assembly but above the sump water surface.

1 Claim, 6 Drawing Sheets

CIRCUITING ARRANGEMENT FOR A CLOSED CIRCUIT COOLING TOWER

BACKGROUND OF THE INVENTION

The present invention provides a coil tube or circuit arrangement for a closed circuit cooling tower. More specifically, a coil tube assembly for a cooling tower, which is usually a counterflow closed-circuit cooling tower, has a coil tube assembly with a plurality of coil circuits. The disclosed method of circuiting the coil assembly for closed-circuit cooling towers gives an enhanced performance, and more particularly enhanced performance for coil assemblies operating at low internal fluid flow.

In a typical coil tube arrangement for a cooling tower, the circuits are provided between an upper header with a fluid inlet nozzle to a lower header with a fluid outlet nozzle. The individual circuits extend from the upper header to the lower header in a serpentine arrangement, which may be generally described as a series of parallel straight tube lengths connected by unshaped bends. Fluid has historically been communicated from the top of the coil tube assembly, or upper header, to the lower header by traversing the plurality of parallel tube lengths.

The fluid to be cooled is circulated inside the tubes of the units heat exchanger. Heat flows from the process fluid through the coil tube wall to the water cascading over the tubes from the spray-water distribution system. Air is forced upward over the coil, evaporating a small percentage of the water, absorbing the latent heat of vaporization and discharging the heat to the atmosphere. The remaining water is recovered in the tower sump for recirculation to the water spray. Water entrained in the air stream is recaptured in mist eliminators at the unit discharge and returned to the sump. It is also known that the water distribution system can be shut off and the unit may be run dry. Air is still forced upward over the coil, but the heat is now solely dissipated to the atmosphere by sensible cooling.

In typical evaporative heat exchangers it has been customary to provide several spray-liquid headers located in superposed relation spanning a bank of tubes carrying a fluid to be cooled. A plurality of smaller tubes or branches extend laterally from the headers, with each branch containing one or more nozzles which emit spray patterns impinging on the fluid carrying tubes.

U.S. Pat. No. 4,196,157 to Schinner teaches a separation arrangement between the adjacent tubes of a coil assembly. In addition, the structural arrangement of a typical closed-circuit cooling tower structure is noted in the text. The typical feed arrangement for the fluid to be cooled is taught and illustrated in this patent with an upper and inlet manifold for receipt of warm fluid for cooling, a lower and outlet manifold for discharge of cooler fluid, and the connection of the serpentine tube assembly therebetween coupling the inlet and outlet manifold. This is an exemplary teaching of the understanding of heat transfer and maximum expected cooling for closed-circuit cooling towers in the prior art.

The preservation of the cooling coil layout has been almost uniformly practiced by the industry as a whole. The direction of fluid flow through the coils or circuits was considered a reflection of a tenet of practice in the closed-circuit cooling tower art. That is, maximum cooling of the fluid would be realized by maintaining the fluid within the tubes counterflowing against the direction of air flow. However, recent developments have noted a spray-water cooling effect, that has heretofore not been taken into account.

SUMMARY OF THE INVENTION

The present invention provides means for recovering the plenum-area, spray-water cooling effect between about the bottom of the cooling coil and the water in the sump. The tube bundles and their layout are generally consistent with prior practice for the purposes of maintaining the structural arrangement of the cooling-tower housing footprint. However, the direction of fluid flow through the tubing has been reconfigured to provide the last leg or segment of each circuit with fluid flow in the vertically upward direction. The upward flow in this last leg or segment takes advantage of the above-noted plenum-area cooling effect, or added cooling, provided below the coil assembly. In this cooling coil assembly arrangement, even for a standard coil assembly, the last leg in the coil is upwardly directed in concurrent flow with the flow of air to better utilize the available heat transfer/temperature reduction for the fluid to be cooled, without incurring any increased operating costs above those associated with current unit operating costs. The prior art generally utilizes inlet and outlet headers or manifolds, which facilitate the handling of multiple tubing structures, but it is known that individually piped arrangements could be configured to accommodate the routing of a tube to produce the directional flow required, and this limitation is considered to be included within the teaching of this application and the use of manifolds to more expeditiously accomplish this task.

BRIEF DESCRIPTION OF THE DRAWING

In the Figures of the Drawing, like reference numerals identify like components, and in the Drawing.

DETAILED DESCRIPTION

Figure 1:
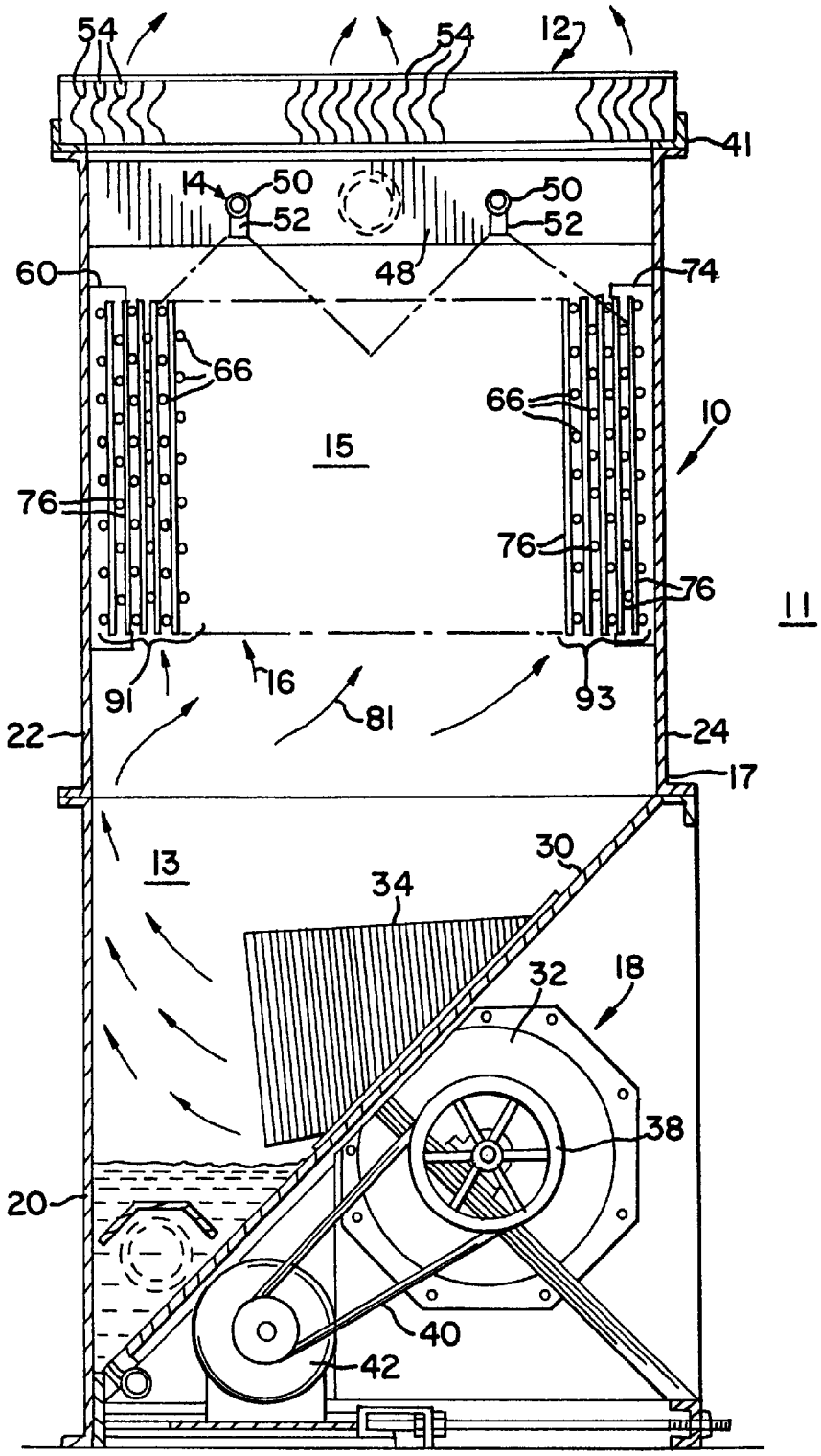
FIG. 1 is a side elevational view, partially in section of a prior art counterflow closed-circuit cooling tower.
Figure 2:
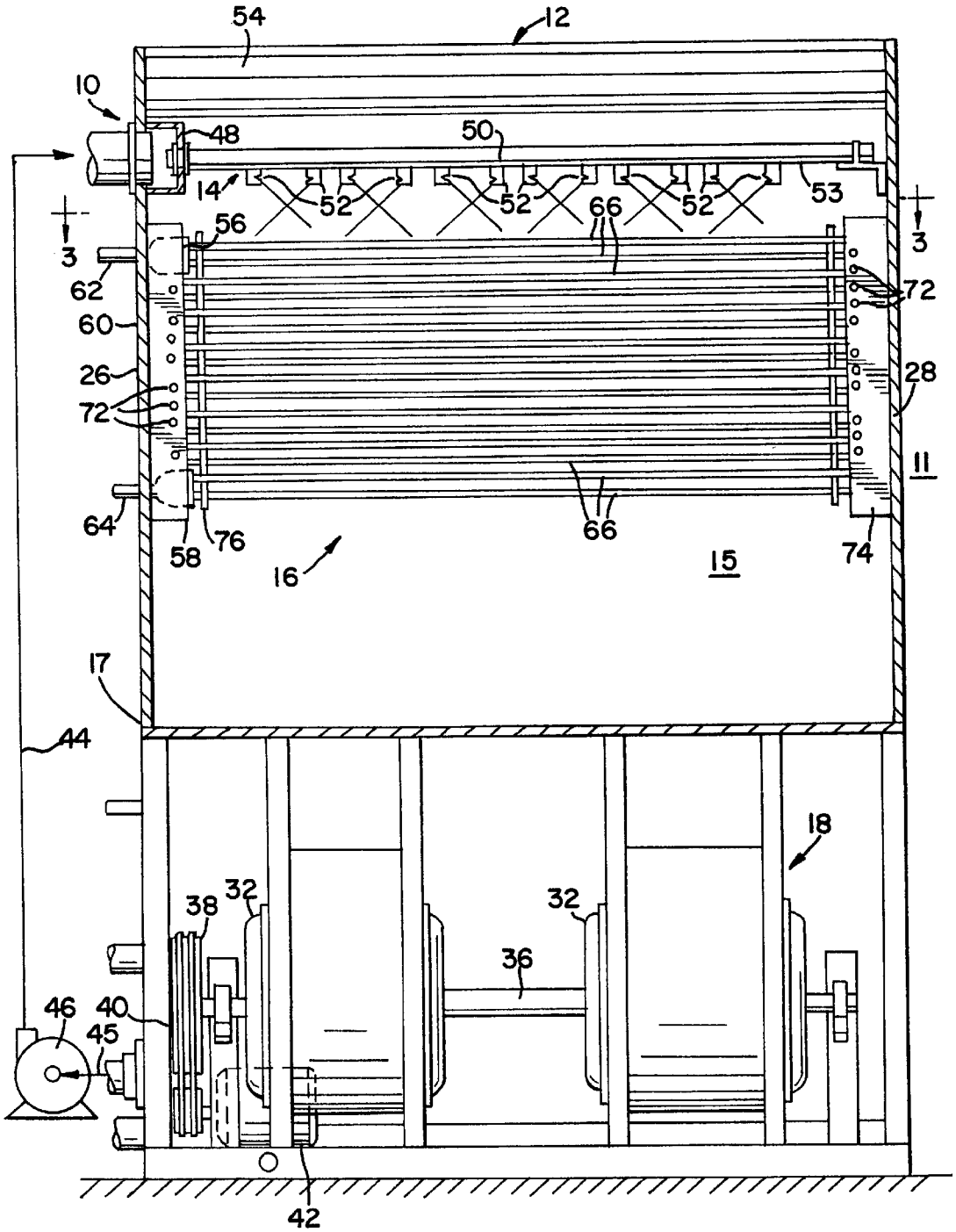
FIG. 2 is a front elevational view, partially broken away and partially in section of the cooling tower in FIG. 1.

The present invention provides reconfiguration of the coil assemblies in closed-circuit cooling towers illustrated in FIG. 1, and more particularly coil circuits for units operating at low internal fluid flows. In this context, fluid refers to gasses and liquids but is typically a liquid. The reconfigured layout of alternative arrangements are particularly noted in FIGS. 10 to 13, but the physical environment and typical position of the coil assemblies are illustrated in FIGS. 1 and 2. Closed-circuit cooling tower 11 of FIGS. 1 and 2 is illustrative of a counterflow structure, but is an exemplary illustration and not a limitation to the present invention. Cooling tower 11 has a generally vertical casing 10 with different levels within its interior, including mist eliminator 12, water spray assembly 14, coil assembly 16, fan assembly 18 and lower water trough or sump 20.

Casing 10 has vertical front wall 24 and rear wall 22 in FIG. 1 with side walls 26 and 28 noted in FIG. 2. Diagonal wall 30 downwardly extends from front wall 24 to rear wall 22 to provide sump 20. Fan assembly 18 is positioned behind and below diagonal wall 30. The illustrated fan assembly 18 has a pair of centrifugal fans 32 with outlet cowls 34 projecting through wall 30 into conduit 13 above sump 20 but below coil assembly 16. Fan assembly 18 includes drive motor 42 and pulley 38 on common drive shaft 36, which pulley 38 and motor 42 are coupled by belt 40.

Recirculation line 45 in FIG. 2 extends through side wall 26 of housing 10 near the base of sump 20. Line 45 extends from sump 20 to recirculation pump 46, line 44 and subsequently to water-spray assembly 14 for communication of fluid for spraying over coil assembly 16.

Water-spray assembly 14 has water box 48 extending along side wall 26 and a pair of distribution pipes 50 extending horizontally across the interior of housing 10 to opposite wall 28. Pipes 50 are fitted with a plurality of nozzles 52, which emit intersecting fan-shaped water sprays to provide an even distribution of water over coil assembly 16. The specific type or style of water spray assembly 14 and nozzle 52 is merely exemplary and not a limitation to the present invention.

Mist eliminator 12 has a plurality of closely spaced elongated strips 54, which are bent along their length to form sinuous paths from the region of water spray assembly 14 through top 41 of housing 10. Mist eliminator 12 extends across substantially the entire cross-section of housing 10 at top 41.

Figure 3:
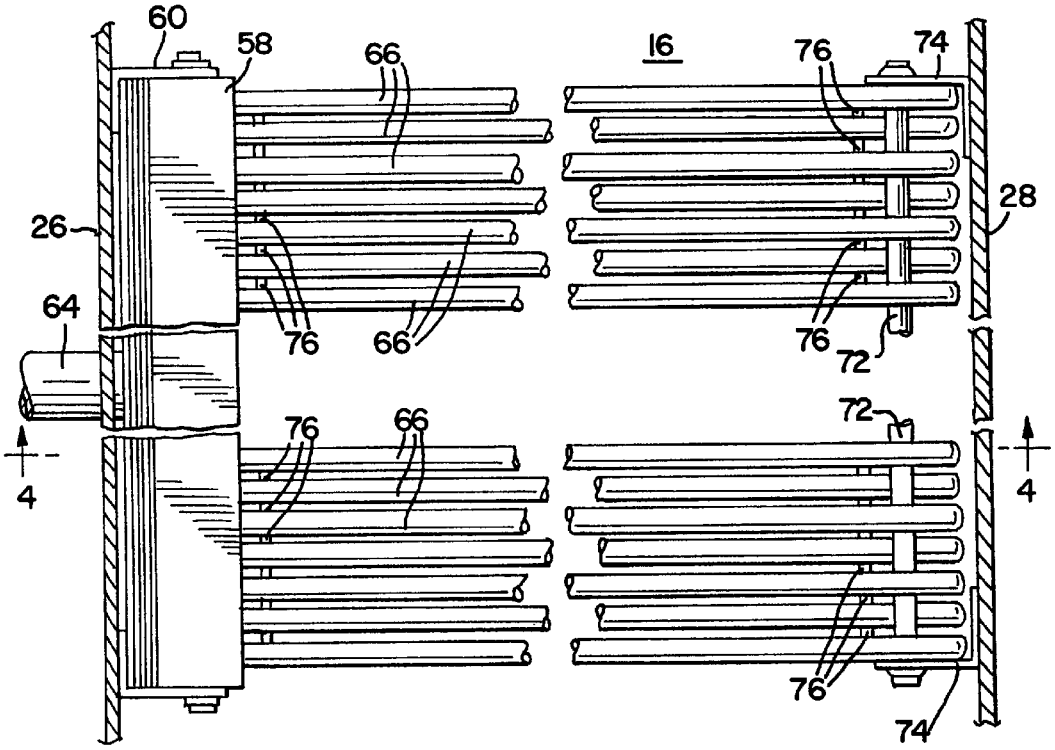
FIG. 3 is a coil assembly in FIG. 2 taken along line 3—3.
Figure 4:
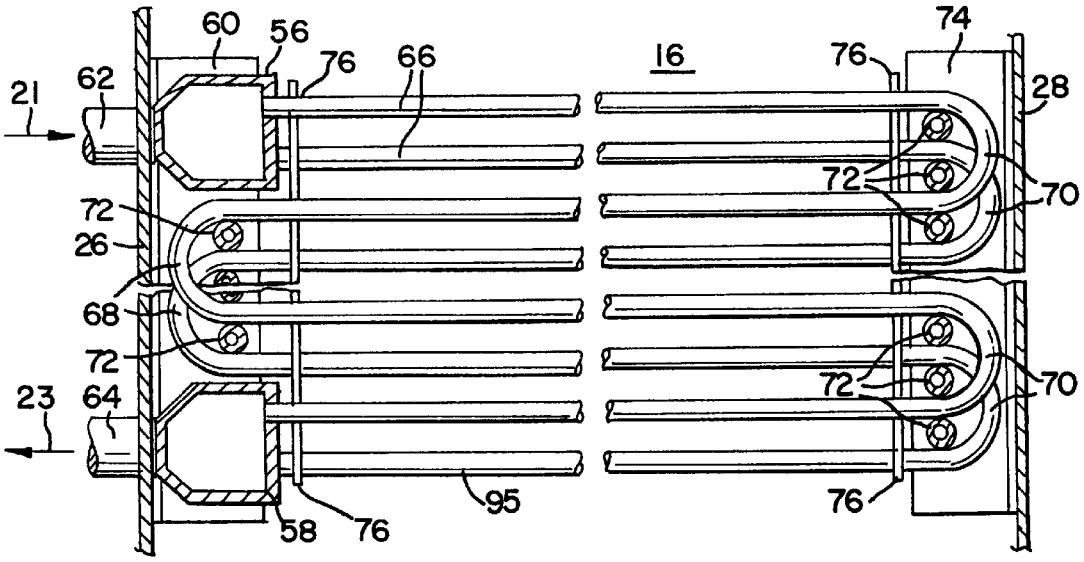
FIG. 4 is the coil assembly in FIG. 3 taken along line 4—4.

Coil assembly 16 is noted in FIGS. 1 and 2 with upper inlet manifold 56 and lower outlet manifold 58, which manifolds 56 and 58 extend horizontally across the upper interior conduit 72 adjacent side wall 26, as noted in FIGS. 2 to 4. Fluid inlet conduit or nozzle 62 and outlet conduit or nozzle 64 extend through side wall 26 and are connected with upper manifold 56 and lower manifold 58, respectively. These fluid nozzles are connected to receive a process fluid to be cooled.

Coil assembly 16 has a plurality of typical circuits 66 connected between upper manifold 56 and lower manifold 58 in FIGS. 2 to 4. In FIG. 1, circuits 91 and 93 at front and rear walls 22 and 24 are only two of multiple circuits that would be provided to fill chamber 15 between walls 22 and 24. Each of these circuits 91 and 93 would extend between upper header 56 and lower header 58 or have an individual header not shown, which may depend upon the header design and the width of chamber 15. Illustrative of the arrangement of two individual tube bundles and their related headers is the tube arrangement noted in FIG. 8.

Each typical circuit 66 in FIGS. 1 to 4 has a plurality of elongated segments 95 and is formed into a serpentine arrangement through 180°-bends 68 and 70 in FIG. 4 near side walls 26 and 28. Thus, different segments 95 of each circuit 66 extend generally horizontally across the interior conduit 72 of housing 10 between side walls 26 and 28 at different levels along parallel vertical planes closely spaced to the plane of each of the other circuits 66. In addition, circuits 66 are arranged in alternately offset arrays with each individual straight length being located a short distance lower or higher than the individual straight lengths on each side of it.

In FIGS. 2 and 4, the vertical connection of circuits 66 with upper manifold 56 and lower manifold 58 is illustrated. Also, in FIG. 4 the inlet fluid-to-be-cooled is noted by arrow 21 at inlet nozzle 62 and discharge of the cooled fluid is noted at discharge nozzle 64, which is demonstrative of the almost universal practice of providing the inlet fluid at the top of interior chamber 15 and discharging the fluid at the lower section of chamber 15.

Figure 5:
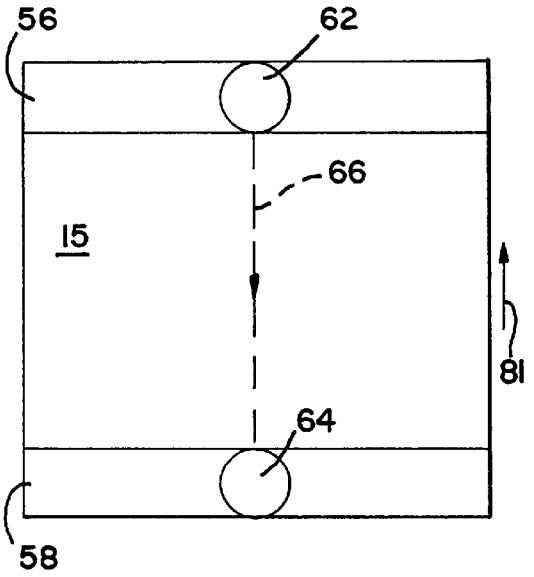
FIG. 5 is a diagrammatic illustration of a standard single-coil assembly.

Alternative prior art tube and header arrangements to provide exposure of the fluid-to-be-cooled to counterflow air in chamber 15 are noted in FIGS. 5 to 9. In FIG. 5, one standard coil assembly 16 with typical circuit 66 is noted as extending between upper manifold 56 and lower manifold 58 and specifically between inlet conduit 62 and discharge conduit 64. As noted above, FIG. 8 illustrates a coil assembly arrangement 16 with two similar circuits 66 and 75 with their own headers 56, 58 in a parallel relationship in chamber 15 of a closed-circuit cooling tower 11.

In operation of a closed-circuit cooling tower 1, fluid-to-be-cooled flows into closed-circuit cooling tower 11 through inlet nozzle 62. This fluid, or process liquid, is then distributed by upper manifold 56 to the upper ends of circuits 66 and it flows down through serpentine tube circuits 66 to lower manifold 68 for discharge from outlet nozzle 64. As the fluid to be cooled flows through circuits 66, water is sprayed from spray nozzles 52 downward onto the outer surfaces of circuits 66 while air is simultaneously blown from fan 32 upward between circuits 66. The sprayed water is collected in sump 20 for recirculation to spray assembly 14. The upwardly flowing air passes through mist eliminator assembly 12 to capture entrained water and return it to sump 20 before exhausting the air from unit 11. Although fan 32 is noted at the lower portion of unit 11, it is known that such fans can be positioned at the tops of such units to pull air through the assembly, and the present assembly 11 is merely exemplary of a closed circuit unit 11 and not a limitation.

As the fluid-to-be-cooled passes downward through circuits 66 from upper manifold 56 to lower manifold 58, the fluid yields heat to the tube walls. This heat passes through the tube walls to the downward flowing water on the tube surface. As the water continues downward, it encounters the upwardly directed air and transfers heat to the air, both by sensible heat transfer and by latent heat transfer, that is by partial evaporation. The remaining water is collected in sump 20 for recirculation. A certain amount of water is entrained in the air as droplets, which are carried from coil assembly 16 and water spray assembly 14. However, as this water bearing air flow is transferred through mist eliminator assembly 12, the liquid droplets are separated from the air and are deposited on the elements of the mist eliminator. The water is then recovered in sump 20.

Figure 6:
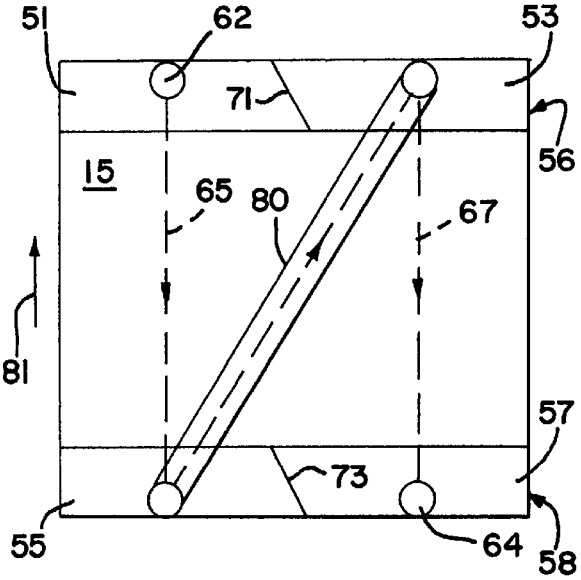
FIG. 6 is a diagrammatic illustration of a half-circuit arrangement of a single coil assembly providing two counterflow segments by reconfiguring the inlet and outlet headers.
Figure 7:
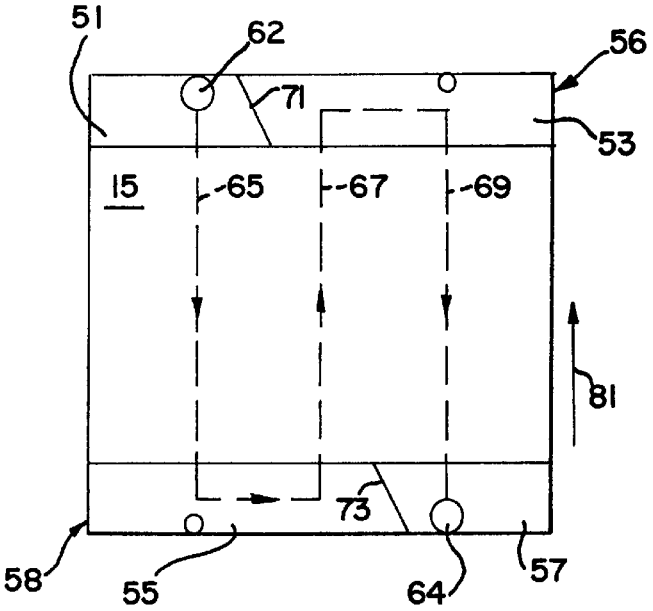
FIG. 7 is a diagrammatic illustration of a one-third circuit coil assembly.

It is also known to provide what is referred to as a half-circuit coil assembly for the standard coil assembly, as shown in FIG. 6, or a one-third circuit coil assembly for a standard coil assembly as shown in FIG. 7. This technique generally reduces the number of parallel circuits, increases the total effective length of the remaining circuits and elevates the fluid velocity in the tubes. This circuiting scheme is typically utilized in coil assemblies where the internal flow rate of the fluid-to-be-cooled is relatively low, which results in relatively low heat transfer coefficients, and is generally associated with only nominal pressure drops in the coil circuit. Although there is usually an increase in the absolute value of the pressure drop across the circuit when utilizing this half-circuit technique, the increase in fluid flow velocity and the resultant increase in thermal efficiency is considered to be worthwhile. It is noted that these low fluid-flow-rate conditions are frequently associated with difficult thermal conditions. These latter conditions may include combinations of large differences in fluid temperature from the coil inlet nozzle to the coil outlet nozzle and/or close approaches of the leaving fluid temperatures to the ambient wet-bulb temperatures.

In a conventional operation, a circuit arrangement with a pressure drop less than approximately three pounds per square inch could be considered for a half-circuit arrangement. Similarly, a circuit arrangement with a pressure drop less than approximately one pound per square inch could be considered for utilization of a one-third circuit arrangement.

FIGS. 5 to 13 are schematic end-connection views of tube bundles similar to the illustration of coil assembly in FIG. 4. In FIG. 5, coil assembly 16 is undivided and the process-fluid flow direction is noted from top to bottom by typical circuit 66. In FIG. 6, coil assembly 16 is split such that a first group of circuits 65 is connected by crossover pipe 80 to a second group of circuits 67. Upper manifold 56 is now provided in a two-section arrangement with first section 51 and second section 53 separated by divider 71. Similarly, lower manifold 58 has been divided by divider 73 into third section 55 and fourth section 57. The sectioning of upper manifold 56 and lower manifold 58 permits fluid flow between upper and lower manifolds, subsequent flow from lower manifold 58 to upper manifold 56 and final discharge at fourth section 57 of lower manifold 58. This inter-manifold fluid transfer permits the fluid-to-be-cooled to flow in series through typical circuits 65 and 67 counter to the air flow in chamber 15.

In FIG. 7, a second alternative circuiting arrangement, which may be referred to as a one-third circuit assembly, is shown with typical circuit 66 of coil assembly 16 noted in FIG. 5 having first segment 65, second segment 67 and third segment 69. In this arrangement, lower-manifold third section 55 acts as a conduit to transfer process fluid between first segment 65 and second segment 67, which fluid is transferred through second segment 67 to upper-manifold second section 53. In this illustration, second upper-manifold section 53 acts as a conduit to transfer fluid to third segment 69. Subsequently, the fluid is transferred through third segment 69 to lower-manifold fourth section 57 and discharge nozzle 64. In this arrangement, the fluid-to-be-cooled is exposed to counterflowing air through first segment 65 and third segment 69. The fluid flow in the figures is noted by arrows on typical circuits 66 and the several noted segments 65, 67 and 69.

In both of the above-noted alternative illustrations, the fluid in typical circuits 66 is exposed to counterflow air in two segments with the expectation that this will further cool the fluid in the segments before its discharge from nozzle 64. However, there are physical fluid dynamic losses from such arrangements including changes in fluid velocity and significant pressure drops from inlet nozzle 62 to outlet nozzle 64. It is known that the half-circuited arrangement of FIG. 6 may experience a pressure drop approximately seven times greater than the pressure drop of assembly of FIG. 5. Further, the one-third circuit of FIG. 7 can be expected to experience a pressure drop of approximately twenty-one times the pressure drop experienced in a standard coil assembly as illustrated in FIG. 5. As the velocity of the fluid in the several coil circuits increases, the internal heat-transfer efficiency of coil assembly 16 increases. The consequent greater pressure drop would be tolerated where the initial pressure drop in a conventional coil arrangement was relatively low.

Figure 9:
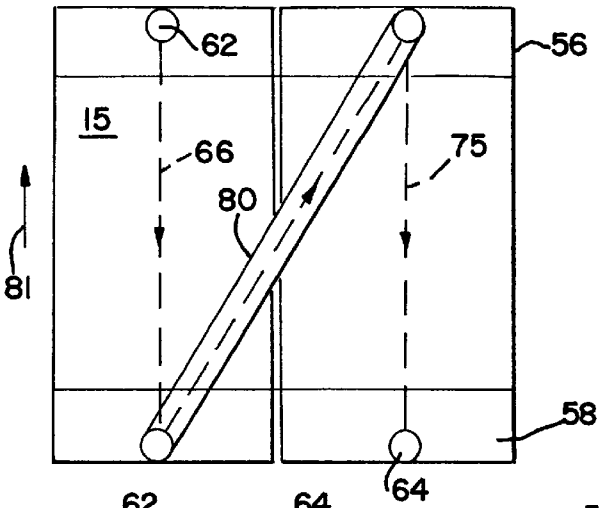
FIG. 9 is a diagrammatic illustration of the coil assembly of FIG. 8 with the two coils arranged in a series connection.
Figure 8:
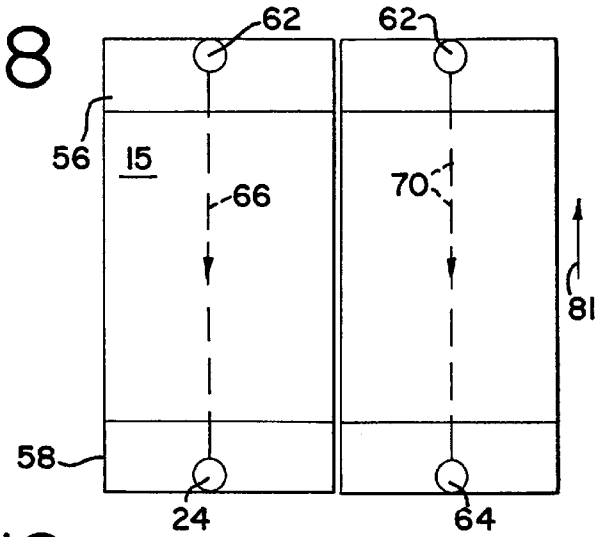
FIG. 8 is a diagrammatic illustration of a standard coil assembly with two counterflow tube arrangements.

FIG. 8 shows a coil assembly 16 having individual typical circuits 66 and 75 extending between upper manifold 56 and lower manifold 58 with individual inlet nozzles 62 and outlet nozzles 64. In FIG. 9, the individual circuits 66 and 75 have been provided in series by coupling crossover pipe 80 between discharge nozzle 64 of circuit 66 and inlet nozzle 62 of circuit 75.

In the above-noted conditions indicated as half-circuited and one-third circuited cases, it is known that the pressure drops through circuits 66 and 75 will increase. The velocity of the fluid will increase as there would be fewer circuits in the same size housing 10, which will increase thermal capacity. It is also known that the thermal capacity gained by these circuiting arrangements and the increased flow velocity will result in the noted increased pressure drops. In high flow-rate, high process-fluid velocity closed-circuit cooling towers 11 it is not generally desired to further increase already significant pressure drops across the system. Thus, the present invention finds particular application in the relatively low fluid velocity, low-pressure drop applications, as noted above, where increases in process-fluid velocity produce more marked increases in thermal capacity while still falling within acceptable pressure drop limits for these systems.

Figure 10:
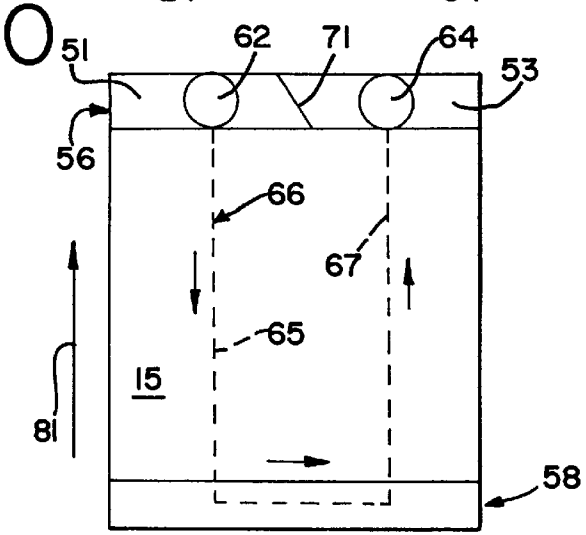
FIG. 10 is a diagrammatic illustration of a single coil assembly arranged with fluid flow on the second segment in parallel with the air flow in a closed-circuit cooling tower.

FIG. 10 is an illustration of a coil assembly 16 with a typical circuit 66, which has been half-circuited. This Figure illustrates the most fundamental case of a closed-circuit cooling tower 11 where upper manifold 56 has been divided into first section 51 with inlet nozzle 62 and second section 53 with outlet nozzle 64. Coil assembly 16 including circuit 66 is positioned in chamber 15 and has inlet nozzle 62 and outlet nozzle 64 in upper manifold 56, which has been divided into first section 51 and second section 53 by divider 73. In this configuration, a fluid outlet nozzle 64 in lower manifold 58, as depicted in the standard coil structure of FIG. 5, has been sealed or is not present. Lower manifold 58 can now be characterized as a conduit communicating fluid between first segment 65 and second segment 67. In this arrangement, air flow is communicated through chamber 15 vertically upward as noted in FIGS. 1 and 2. Thus, process-fluid flow in segments 65 and 67 is exposed to air flow in both segments 65 and 67. However, process fluid flow in segment 65 is counterflow with the air flow, and in segment 67 it is in parallel concurrent flow with the air flow.

It has been found that spray-water cooling occurs in chamber 15 in the region below coil assembly 16 and above the water in sump 20. In comparison to fluids discharged at lower manifold 58, as noted in the prior art arrangements of FIGS. 1 to 9, this spray-water cooling region can be used to induce a lower outlet-temperature in the process fluids for subsequent transfer to discharge nozzle 64 after parallel flow in the direction of air flow. Alternative coil-assembly arrangements utilizing the current invention are shown in FIGS. 10 to 13. Typical circuits 66 or segments 65, 67 are still arranged in series, which was noted in FIGS. 6, 7 and 9. However, in the present invention, the final leg or segment 67 in FIGS. 10 and 11 directs fluid flow in coil assembly 16 in the same direction as air flow in chamber 15, which is in contradistinction to the dominant teaching of the prior art.

The illustrated modification to typical circuit 66 in FIG. 10 would be expected to approximately double the velocity of the process-fluid flow, which would increase the internal film coefficient and overall rate of heat transfer of coil assembly 16. The cooling capacity of unit 11 would be expected to increase by twenty percent or more over the conventional circuiting arrangement shown in FIG. 5, but the percentage increase would be dependent upon the process-fluid velocity in a standard unit and the specific thermal conditions. However, the rearrangement of the circuiting shown in FIG. 10 would be expected to produce a further increase of up to ten percent over the rearranged half-circuit example of FIG. 6. It is also recognized that there would be an increase in the pressure drop between the inlet nozzle 62 and the outlet nozzle 64 over the same standard unit 11. Although these operating results are recognized, it is considered that the increase in the pressure drop would be tolerable and the increase in thermal performance would be measurably significant. That is, it has been found that for the same flow rate there is a measurable decrease in the outlet temperature of the fluid-to-be-cooled, which is provided by changing the position of outlet nozzle 64, and utilizing the previously unrecognized available spray-water cooling capacity. In this arrangement, fluid flow in final segment 67 is provided in a concurrent direction with the air flow noted at arrow 81.

Figure 11:
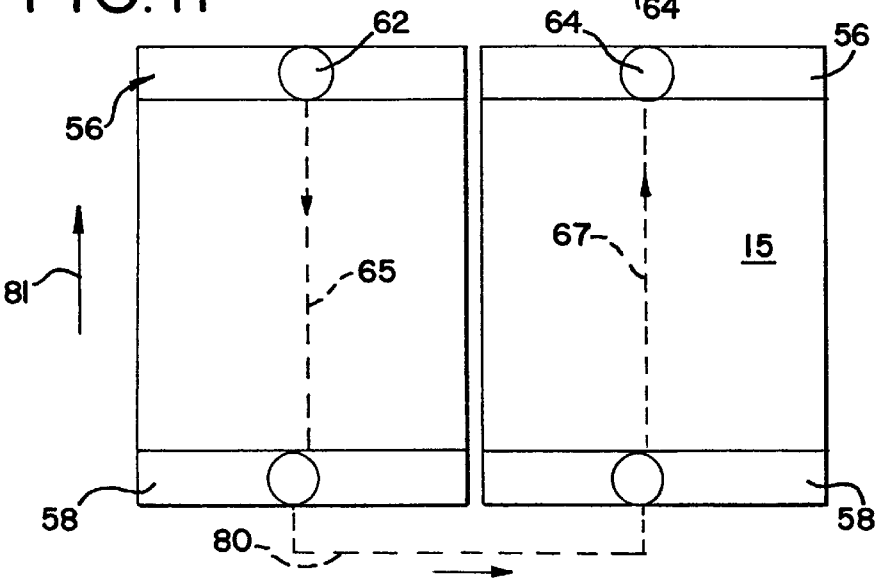
FIG. 11 is a diagrammatic illustration of a two coil arrangement that has been half-circuited to provide the segment coil with fluid flow parallel to air flow in a closed-circuit cooling tower.

FIG. 11 illustrates a two-coil arrangement that has been half-circuited, that is two typical circuits 66 have been joined in a series connection. More specifically first circuit 66 is noted as segment 65, and second circuit 66 is noted as segment 67 in this arrangement, which segments 65 and 67 were originally independent circuits each with an inlet nozzle 62 in upper manifold 56 and an outlet nozzle 64 in lower manifold 58. However, in this illustration, the nozzles in lower manifolds 58 are coupled by external crossover pipe 80. Thus, inlet port 62 and upper manifold 56 are coupled to lower manifold 58 by segment 65. Lower manifolds 58 and crossover pipe 80 now function as a conduit between first segment 65 and second segment 67, which segment is connected between lower manifold 58 and outlet nozzle 64 in upper manifold 56. In this arrangement of FIG. 11, fluid flow in final segment 67 is again provided in a concurrent direction with the air flow noted at arrow 81, and communicates from lower section 17 of chamber 15 at the final segment transfer. Lower section 17 is noted in FIG. 1 of closed-circuit cooling tower 11.

Figure 12:
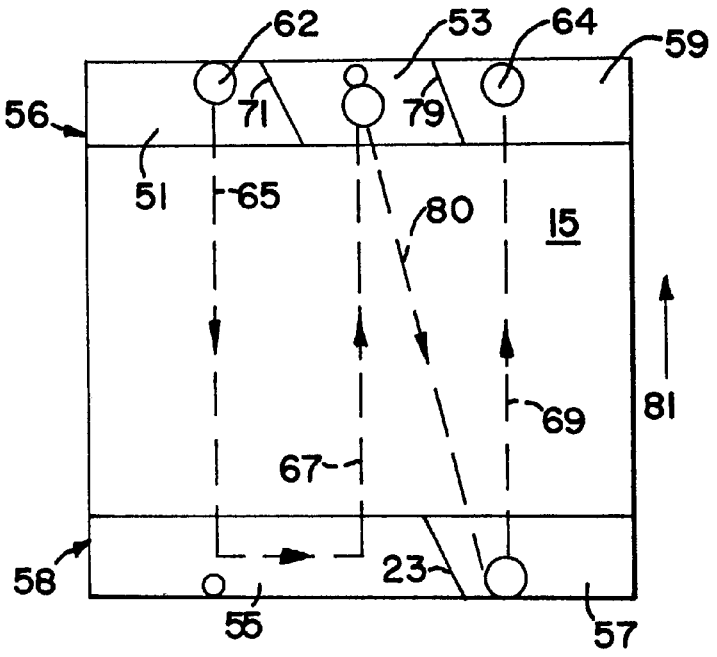
FIG. 12 is a diagrammatic illustration of a one-third circuit coil assembly with the last coil segment having fluid flow in parallel with the air flow in a closed-circuit cooling tower; and, FIG. 13 is an alternative arrangement of a one-third circuit coil assembly with the last coil segment having fluid flow in parallel with the air flow in a closed-circuit cooling tower.

FIG. 12 illustrates an alternative embodiment or tube arrangement wherein typical circuit 66 is provided as a one-third circuit coil assembly. In this figure, upper manifold 56 has first divider 71 and third divider 79 while lower manifold 58 has second divider 73. In this arrangement, lower manifold 58 has third section 55 and fourth section 57, which is consistent with the illustration of FIG. 6. However, upper manifold 56 now includes first section 51, second section 53 and fifth section 59, which also includes outlet nozzle 64. In this configuration, inlet nozzle 62 and first section 51 are connected to lower manifold third section 55 by segment 65. Second segment 67 couples second upper-manifold section 53 and lower-manifold third section 55, where lower manifold section 55 acts as a conduit between segments 65 and 67. Crossover pipe 80 in this arrangement couples segment 67 at upper-manifold, second section 53 to segment 69 at lower-manifold, fourth-section 57, which crossover pipe 80 may be noted as an external pipe section. Subsequently, segment 69 communicates fluid from lower-manifold fourth-section 57 to upper-manifold, fifth section 59 and outlet nozzle 64. In this configuration of FIG. 12, final segment 69 provides fluid flow in a concurrent direction with the air flowing through chamber 15, as noted by arrow 81.

Figure 13:
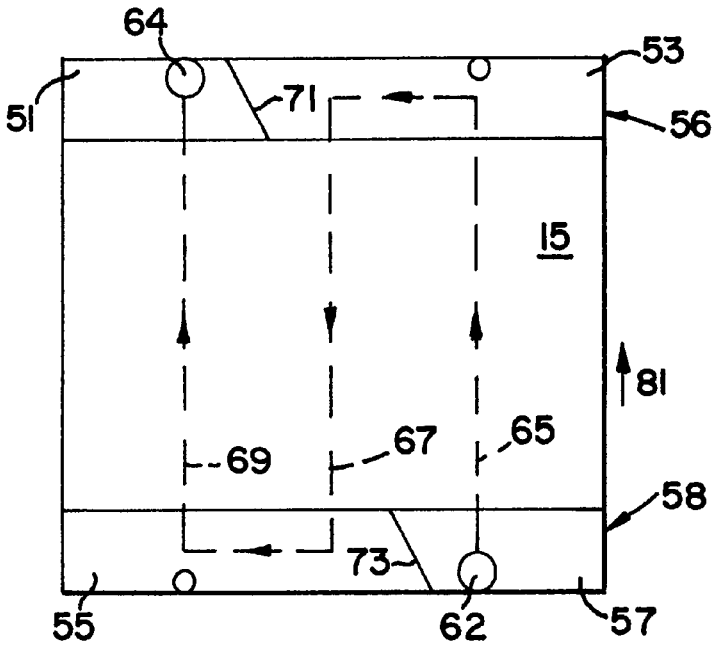

FIG. 13 illustrates a second alternative embodiment wherein typical circuit 66 is provided as a one-third circuit coil assembly. In this figure, upper manifold 56 has first divider 71, which again divides manifold 56 into first section 51 and second section 53. Lower manifold 58 has second divider 73, which divides manifold 58 into third section 55 and fourth section 57. In this embodiment, inlet nozzle 62 is positioned in fourth section 57 of lower manifold 58, and first segment 65 is connected between inlet nozzle 62 and second section 53 of upper manifold 56. Second segment 67 couples upper manifold, second section 53 and lower-manifold, third section 55 for transfer of fluid to third section 55 at lower end 17 of chamber 15. Third segment 69 is connected between lower-manifold, third section 55 and upper-manifold, first section 51 and outlet nozzle 64 for discharge of fluid. In this illustration, upper-manifold section 53 serves as a conduit between first segment 65 and second segment 67. Similarly, lower-manifold segment 55 serves as a conduit between second segment 67 and third segment 69 for communication of fluid. In this configuration, both first and third segments 65 and 69 provide fluid flow in the same direction as the air flow noted at arrow 81, and thus final segment 69 provides fluid flow in the air-flow direction from lower region 17 of chamber 15.

In operation, closed-circuit cooling tower 11 appears as a standard operating system. However, the present invention more fully utilizes available cooling capacity, which was previously underutilized, to reduce the temperature of the fluid to be cooled communicating through coil assembly 16 and typical circuits 66. The amount of increased cooling may be dependent upon the particular size of unit 11 and the operating parameters associated therewith, such as air flow velocity, fluid flow rate and pressure drop of the fluid. However, utilization of the available cooling and the reduced fluid outlet temperature can be provided at no increase in capital expenditure. Thus, increases in cooling are available for extant heat exchange units without increasing the structure sizes. It is acknowledged that there may be currently unrecognized unit-size or operating parameter limitations to take advantage of this heretofore unused capacity. However, it is clear that this available cooling capacity may be readily utilized by relatively low-pressure drop, low process-fluid-velocity units 11, which low-pressure drop units 11 are known by these terms in the HVAC industry.

The operable condition provides that the final circuit segment communicating to fluid outlet nozzle 64 in the above-shown examples is to be provided in a parallel flow direction with the air flow from the lower area 17 of plenum chamber 15. The positions of the mechanical operating equipment of the various systems, such as pump 46 and fan 32, may be changed as a design choice, but such changes are not required for the present invention. In addition, the alternative structures of FIGS. 12 and 13 clearly note that the position of inlet nozzle 62 may be accommodated by alternatives. Although the illustrations note only one or two manifolds in the side-by-side relationships of circuits or tube bundles 66, it is considered that these are demonstrative of coil assemblies 16 which may require multiple circuits 66 to fill chamber 15 in a typical closed-circuit cooling tower 11.

While only specific embodiments of the invention have been described and shown, it is apparent that various alterations and modifications can be made therein. It is, therefore, the intention in the appended claims to cover all such modifications and alterations as may fall within the scope and spirit of the invention.

I claim:

1. A circuit arrangement for a coil assembly of a closed circuit cooling tower, said closed-circuit cooling tower having a coil chamber with an upper end and a lower end, an air transfer assembly for communication of air between said chamber lower end and said chamber upper end, a liquid spray assembly, said coil assembly mounted in said coil chamber, said coil assembly having a top end in proximity to said chamber upper end and a bottom end in proximity to said chamber lower end, a fluid-to-be-cooled, at least one inlet nozzle and one outlet nozzle for said fluid-to-be-cooled, means for providing said fluid-to-be-cooled, said fluid providing means coupled to said inlet nozzle, said circuit arrangement for said coil assembly comprising:

at least one cooling coil circuit in said coil assembly, said cooling coil circuit operable to communicate said fluid-to-be-cooled from said inlet nozzle to said outlet nozzle, each said cooling coil circuit arranged in said chamber to communicate fluid-to-be-cooled between said chamber upper end and chamber lower end, each said cooling coil circuit having a first segment and a second segment, said coil assembly further comprising an upper manifold and a lower manifold, said lower manifold mounted in proximity to said chamber lower end, said upper manifold mounted in proximity to said chamber upper end, a divider in said upper manifold separating said upper manifold into a first section and a second section, said inlet nozzle positioned in said upper manifold first section, said outlet positioned in said upper manifold second section;

each said cooling coil circuit having a plurality of tubing lengths, each said tubing length having a first segment and a second segment;

said first segment extending from said upper manifold first section to said lower manifold, and said second segment extending from said lower manifold to said upper manifold second section.

* * * * *